US010262571B2

(12) United States Patent
Song et al.

(10) Patent No.: US 10,262,571 B2
(45) Date of Patent: Apr. 16, 2019

(54) METHOD AND APPARATUS FOR CONTROLLING IMAGE DISPLAY OF WOLED DISPLAY APPARATUS AND DISPLAY APPARATUS

(71) Applicant: BOE Technology Group Co., Ltd., Beijing (CN)

(72) Inventors: Danna Song, Beijing (CN); Cuili Gai, Beijing (CN); Szu Heng Tseng, Beijing (CN); Song Meng, Beijing (CN); Zhongyuan Wu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 267 days.

(21) Appl. No.: 15/037,797

(22) PCT Filed: Oct. 21, 2015

(86) PCT No.: PCT/CN2015/092422
§ 371 (c)(1),
(2) Date: May 19, 2016

(87) PCT Pub. No.: WO2016/062248
PCT Pub. Date: Apr. 28, 2016

(65) Prior Publication Data

US 2016/0307493 A1 Oct. 20, 2016

(30) Foreign Application Priority Data

Oct. 23, 2014 (CN) ..... 2014 1 0573406

(51) Int. Cl.
*G09G 3/20* (2006.01)
*G09G 3/3208* (2016.01)
*G09G 3/3225* (2016.01)

(52) U.S. Cl.
CPC ..... *G09G 3/2074* (2013.01); *G09G 3/2003* (2013.01); *G09G 3/3208* (2013.01);
(Continued)

(58) Field of Classification Search
CPC .. G09G 3/2074; G09G 3/3208; G09G 3/2003; G09G 3/3225; G09G 2330/021;
(Continued)

(56) References Cited

U.S. PATENT DOCUMENTS 6,181,445 B1 1/2001 Lin et al.
2003/0117414 A1* 6/2003 Sasaki ..... G09G 3/006 345/589

(Continued)

FOREIGN PATENT DOCUMENTS

CN 101369416 2/2009
CN 101866642 10/2010

(Continued)

OTHER PUBLICATIONS

International Search Report and Written Opinion for International Application No. PCT/CN2015/092422, dated Jan. 19, 2016.

(Continued)

*Primary Examiner* — Alexander Eisen
*Assistant Examiner* — Kebede Teshome
(74) *Attorney, Agent, or Firm* — Westman, Champlin & Koehler, P.A.

(57) ABSTRACT

The present disclosure provides a method and an apparatus for controlling image display of a WOLED display apparatus and a WOLED display apparatus. The method includes: converting gray scale data of respective lights with various colors inputted by a signal source into brightness data of the respective lights with various colors; acquiring brightness adjustment data of white sub-pixel lights and brightness adjustment data of the respective lights with various colors (Continued)

on the basis of the brightness data of the respective lights with various colors and proportions of the respective lights with various colors in the white sub-pixel lights; converting the brightness adjustment data of white sub-pixel lights and brightness adjustment data of the respective lights with various colors into gray scale data and outputting and displaying the gray scale data. The above method and apparatus provides a simple calculating method when adjusting the display data and may eliminate color cast.

17 Claims, 5 Drawing Sheets

(52) U.S. Cl.
CPC ... *G09G 3/3225* (2013.01); *G09G 2300/0452* (2013.01); *G09G 2320/0233* (2013.01); *G09G 2320/0295* (2013.01); *G09G 2320/0646* (2013.01); *G09G 2320/0666* (2013.01); *G09G 2320/0673* (2013.01); *G09G 2320/0693* (2013.01); *G09G 2330/021* (2013.01); *G09G 2340/06* (2013.01)

(58) Field of Classification Search
CPC ... G09G 2300/0452; G09G 2320/0693; G09G 2320/0295; G09G 2320/0673; G09G 2320/0233; G09G 2320/0646; G09G 2320/0666
See application file for complete search history.

(56) References Cited

U.S. PATENT DOCUMENTS

| | | | | |
|---|---|---|---|---|
| 2006/0268003 | A1 | 11/2006 | Tanase et al. | |
| 2008/0252797 | A1 | 10/2008 | Hamer et al. | |
| 2011/0149166 | A1* | 6/2011 | Botzas | H04N 5/202 348/649 |
| 2011/0285738 | A1* | 11/2011 | Hsieh | G09G 5/02 345/589 |
| 2014/0198140 | A1 | 7/2014 | Yano et al. | |

FOREIGN PATENT DOCUMENTS

| | | |
|---|---|---|
| CN | 102426821 | 4/2012 |
| WO | 2014/024577 A1 | 2/2014 |

OTHER PUBLICATIONS

English translation of Box No. V from the Written Opinion of the International Searching Authority for International Application No. PCT/CN2015/092422, dated Jan. 19, 2016.
Extended European Search for European Patent Application No. 15852161.7, dated Apr. 30, 2018, 18 pages.
Arnold, A.D. et al., "Full-color AMOLED with RGBW pixel pattern", XP008061646, Journal of the SID 13/6, 2005, 11 pages.

* cited by examiner

METHOD AND APPARATUS FOR CONTROLLING IMAGE DISPLAY OF WOLED DISPLAY APPARATUS AND DISPLAY APPARATUS

CROSS-REFERENCE TO RELATED APPLICATION

This application is a Section 371 National Stage Application of International Application No. PCT/CN2015/092422, filed Oct. 21, 2015 and published as WO 2016/062248 on Apr. 28, 2016, and which claims priority to Chinese Application No. 201410573406.9, filed with SIPO on Oct. 23, 2014, incorporated herein by reference in their entirety.

BACKGROUND OF THE INVENTION

Field of the Invention

The present disclosure generally relates to the field of image display, and in particular, to a method and an apparatus for controlling image display of a WOLED display apparatus and a display apparatus.

Description of the Related Art

Active Matrix Organic Light Emitting Diodes (AMOLED) have been greatly interested as next generation display devices due to their advantages of high response speed, high luminous efficiency, high brightness and wide field of view. The organic light emitting diode devices achieve image display by controlling current flowing in the organic light emitting diodes (OLED) using thin film transistors (TFT).

A typical OLED device includes a plurality of pixels, each of which includes a R (red) sub-pixel, a G (green) sub-pixel and a B (blue) sub-pixel for full-colors display. An R light emitting layer for producing a red light is formed on the R sub-pixel. A G light emitting layer for producing a green light is formed on the G sub-pixel. A B light emitting layer for producing a blue light is formed on the B sub-pixel. The light emitting layers are deposited individually for the respective sub-pixels by such as fine metal mask (FMM) method using a metal mask. However, the larger the size of the substrate is, the larger the curvature of the mask becomes. Thus, the conventional FMM deposition method will reduce the yield as it is difficult to pattern the light emitting layers accurately. As a result, the method is very difficult to be used to produce display with large area and high precision.

As such, in recent years, a technology for using a white OLED (WOLED) device to achieve colored display apparatus was developed. It does not need the fine metal mask (FMM) during forming the light emitting layers of the OLED device. The white OLED has an arrangement in which such as the R light emitting layer, the G light emitting layer, the B light emitting layer and the like are laminated optionally between a cathode and an anode to form the white OLED for the respective sub-pixels. The white OLED display has a plurality of pixels, each of which includes a R sub-pixel, a G sub-pixel, a B sub-pixel and a W (white) sub-pixel for colored display. The R sub-pixel includes an R color filter configured to transmit a red light in a white light from the white OLED. The G sub-pixel includes a G color filter configured to transmit a green light in a white light from the white OLED. The B sub-pixel includes a B color filter configured to transmit a blue light in a white light from the white OLED. The W sub-pixel may not be provided with color filters and may transmit all of white light from the white OLED to compensate for the degradation of brightness of image caused by the color filters.

Such white OLED display generates W data from R data, G data and B data inputted from the external and modulates the R data, G data and B data outputted subsequently using the generated W data. The W data, the modulated R data, the modulated U data and the modulated B data are displayed in the W sub-pixels, the R sub-pixels, the G sub-pixels and the B sub-pixels respectively.

SUMMARY

An embodiment of the present invention provides a method for controlling image display of a WOLED display apparatus, including:

converting gray scale data of respective lights with various colors inputted by a signal source into brightness data of the respective lights with various colors;

acquiring brightness adjustment data of white sub-pixel lights and brightness adjustment data of the respective lights with various colors on the basis of the brightness data of the respective lights with various colors and proportions of the respective lights with various colors in the white sub-pixel lights;

converting the brightness adjustment data of white sub-pixel lights and brightness adjustment data of the respective lights with various colors into gray scale data and outputting and displaying the gray scale data;

wherein the acquired brightness adjustment data of the white sub-pixel lights meet the following two conditions:

the brightness data of a light with one color in the lights with various colors are product of the brightness adjustment data of the white sub-pixel lights and a proportion of the light with one color in the white sub-pixel lights; and the brightness data of each one of the lights with other colors in the lights with various colors are greater than product of the brightness adjustment data of the white sub-pixel lights and the proportion of the one of the lights with other colors in the white sub-pixel lights.

In an embodiment, the brightness data of the light with one color are zero and the brightness adjustment data of each one of the lights with other colors are differences between.

In an embodiment, acquiring brightness adjustment data of white sub-pixel lights and brightness adjustment data of the respective lights with various colors on the basis of the brightness data of the respective lights with various colors and proportions of the respective lights with various colors in the white sub-pixel lights includes:

selecting one of the respective lights with various colors as a present color light and calculating the brightness adjustment data of the white sub-pixel light when the brightness data of the present color light are product of the brightness adjustment data of the white sub-pixel lights and the proportion of the present color light in the white sub-pixel lights;

subtracting the calculated product of the brightness adjustment data of the white sub-pixel lights and the proportion of each one of the lights with various colors other than the present color light in the white sub-pixel lights from the brightness data of the one of the lights with various colors other than the present color light, to calculate the brightness adjustment value of each one of the lights with various colors other than the present color light;

determining whether the calculated brightness adjustment value of each one of the lights with various colors other than the present color light is greater than zero;

outputting the brightness adjustment data of the white sub-pixel light and the brightness adjustment data of each one of the lights with various colors other than the present color light and outputting the brightness adjustment data of the present color light in the respective lights with various colors as zero if the calculated brightness adjustment value of each one of the lights with various colors other than the present color light is greater than zero, otherwise, selecting another one of the respective lights with various colors as the present color light and repeating the above steps to recalculate the brightness adjustment data of the white sub-pixel light and the brightness adjustment data of the respective lights with various colors.

In an embodiment, the proportions of the respective lights with various colors in the white sub-pixel light are obtained by measuring color coordinates of light emitted by white sub-pixels and color coordinates of lights emitted by respective sub-pixels with various colors.

In an embodiment, converting gray scale data of respective lights with various colors inputted by a signal source into brightness data of the respective lights with various colors and converting the brightness adjustment data of white sub-pixel lights and brightness adjustment data of the respective lights with various colors into gray scale data are achieved by conversion based on gamma curves of the respective lights with various colors and the white sub-pixel lights.

In an embodiment, the method further include: adjusting the gamma curves of the respective lights with various colors and the white sub-pixel lights in advance before conversion based on gamma curves of the respective lights with various colors and the white sub-pixel lights is done.

In an embodiment, adjusting the gamma curves of the respective lights with various colors and the white sub-pixel lights in advance includes:

measuring color coordinates of the respective lights with various colors in a test picture displayed on a display;

calculating the proportion of each one of the respective lights with various colors in a target white light using color coordinates of the target white light and the measured color coordinates of the respective lights with various colors;

determining the maximum gray scale brightness data of the respective lights with various colors using the maximum gray scale brightness data of the target white light and the proportions of the respective lights with various colors in the target white light; and adjusting gamma curves of the respective lights with various colors respectively using the maximum gray scale brightness data of the respective lights with various colors.

In an embodiment, adjusting the gamma curves of the respective lights with various colors and the white sub-pixel lights in advance includes:

measuring color coordinates of the respective lights with various colors and color coordinates of the white sub-pixel lights in a test picture displayed on a display, and calculating the proportion of each one of the respective lights with various colors in the white sub-pixel lights using color coordinates of the respective lights with various colors and color coordinates of the white sub-pixel lights;

determining the maximum gray scale brightness data of the white sub-pixel lights on the basis of the maximum gray scale brightness values of the respective lights with various colors and the proportion of each one of the respective lights with various colors in the white sub-pixel light; and adjusting gamma curves of the white sub-pixel lights using the maximum gray scale brightness data of the white sub-pixel lights.

In an embodiment, the maximum gray scale brightness data of the white sub-pixel lights meets the following two conditions:

the maximum gray scale brightness value of a light with one color in the lights with various colors are product of the maximum gray scale brightness value of the white sub-pixel lights and the proportion of the light with one color in the white sub-pixel lights; and the maximum gray scale brightness value of each one of the lights with other colors in the lights with various colors is greater than product of the maximum gray scale brightness value of the white sub-pixel lights and the proportion of the one of the lights with other colors in the white sub-pixel lights.

In an embodiment, the maximum gray scale values of the respective lights with various colors are obtained by the adjusted gamma curves of the respective lights with various colors.

In an embodiment, the various colors include three colors of red, green and blue.

An embodiment of the present disclosure provides an apparatus for controlling image display of a WOLED display apparatus, including:

a converting unit configured to convert gray scale data of respective lights with various colors inputted by a signal source into brightness data of the respective lights with various colors;

an adjusting unit configured to acquire brightness adjustment data of white sub-pixel lights and brightness adjustment data of the respective lights with various colors on the basis of the brightness data of the respective lights with various colors and proportions of the respective lights with various colors in the white sub-pixel lights;

an inverse converting unit configured to convert the brightness adjustment data of white sub-pixel lights and brightness adjustment data of the respective lights with various colors into gray scale data and outputting and displaying the gray scale data;

wherein the brightness adjustment data of the white sub-pixel lights acquired by the adjusting unit meet the following two conditions:

the brightness data of a light with one color in the lights with various colors are product of the brightness adjustment data of the white sub-pixel lights and a proportion of the light with one color in the white sub-pixel lights; and the brightness data of each one of the lights with other colors in the lights with various colors are greater than product of the brightness adjustment data of the white sub-pixel lights and the proportion of the one of the lights with other colors in the white sub-pixel lights.

In an embodiment, the adjusting unit is configured to:

select one of the respective lights with various colors as a present color light and to calculate the brightness adjustment data of the white sub-pixel lights when the brightness data of the present color light are equal to product of the brightness adjustment data of the white sub-pixel lights and the proportion of the present color light in the white sub-pixel lights;

subtract the calculated product of the brightness adjustment data of the white sub-pixel lights and the proportion of each one of the lights with various colors other than the present color light in the white sub-pixel lights from the brightness data of the one of the lights with various colors other than the present color light, to calculate the brightness adjustment value of each one of the lights with various colors other than the present color light;

deter mine whether the calculated brightness adjustment value of each one of the lights with various colors other than the present color light is greater than zero;

output the brightness adjustment data of the white sub-pixel light and the brightness adjustment data of each one of the lights with various colors other than the present color light and output the brightness adjustment data of the present color light in the respective lights with various colors as zero if the calculated brightness adjustment value of each one of the lights with various colors other than the present color light is greater than zero, otherwise, select another one of the respective lights with various colors as the present color light and repeat the above steps to recalculate the brightness adjustment data of the white sub-pixel light and the brightness adjustment data of the respective lights with various colors.

In an embodiment, the apparatus further includes:

a gamma curve adjusting unit configured to adjust gamma curves of the respective lights with various colors and the white sub-pixel lights before controlling image display.

In an embodiment, the gamma curve adjusting unit is configured to:

measure color coordinates of the respective lights with various colors and color coordinates of the white sub-pixel lights in a test picture displayed on a display, and calculate the proportion of each one of the respective lights with various colors in the white sub-pixel tights using color coordinates of the respective lights with various colors and color coordinates of the white sub-pixel lights;

calculate the proportion of each one of the respective lights with various colors in a target white light using color coordinates of the target white light and the measured color coordinates of the respective lights with various colors;

determine the maximum gray scale brightness data of the respective lights with various colors using the maximum gray scale brightness data of the target white light and the proportions of the respective lights with various colors in the target white light adjust gamma curves of the respective lights with various colors respectively using the maximum gray scale brightness data of the respective lights with various colors;

determine the maximum gray scale brightness data of the white sub-pixel lights on the basis of the maximum gray scale brightness values of the respective lights with various colors and the proportion of each one of the respective lights with various colors in the white sub-pixel lights; and adjust gamma curves of the white sub-pixel lights using the maximum gray scale brightness data of the white sub-pixel lights.

An embodiment of the present invention provides a WOLED display apparatus including the apparatus for controlling image display as described in any one of the above embodiments.

DETAILED DESCRIPTION OF PREFERRED EMBODIMENTS OF THE INVENTION

The embodiments of the present invention will be further explained below with reference to the figures and examples such that the objects, solutions and advantages of the present disclosure will become more apparent.

The present disclosure provides a method for controlling image display of a WOLED display apparatus. It generally calculates the brightness adjustment values of the respective lights with various colors and the brightness adjustment values of the white sub-pixel lights in accordance with brightness values in the respective light data with various colors (such as RGB data) in an image to be displayed inputted from a signal source, such that part of the sub-pixels in the sub-pixels corresponding to various colors emit light to compensate for the lights with the corresponding colors, in case that the white sub-pixels emit corresponding white light.

In addition, for the purpose of explanation, numerous specific details are set forth in the following detailed description to provide a thorough understanding to the embodiments of the present invention. It is obvious, however, that one or more embodiments can also be implemented without these specific details. In other instances, well-known structures and devices are shown in an illustrative manner so as to simplify the drawings.

Figure 1:
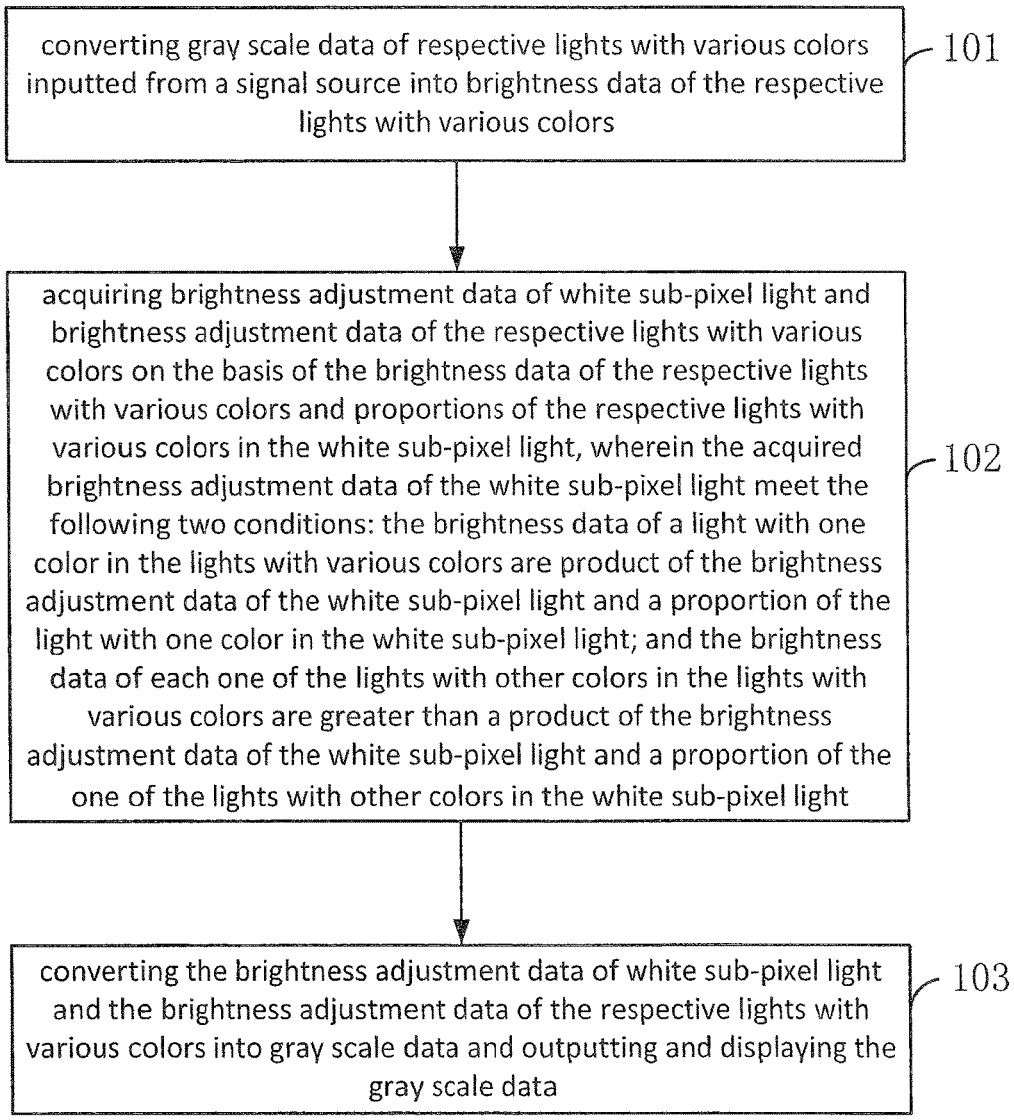
FIG. 1 is a flow chart of a method for controlling image display in a WOLED display apparatus in the present disclosure.

FIG. 1 shows a flow chart of a method for controlling image display of a WOLED display apparatus provided by the present disclosure. The method includes:

Step 101: converting gray scale data of respective lights with various colors inputted by a signal source into brightness data of the respective lights with various colors;

Step 102: acquiring brightness adjustment data of white sub-pixel lights and brightness adjustment data of the respective lights with various colors on the basis of the brightness data of the respective lights with various colors and proportions of the respective lights with various colors in the white sub-pixel lights;

Step 103: converting the brightness adjustment data of white sub-pixel lights and brightness adjustment data of the respective lights with various colors into gray scale data and outputting and displaying the gray scale data;

wherein the acquired brightness adjustment data of the white sub-pixel lights meet the following two conditions:

the brightness data of a light with one color in the lights with various colors are product of the brightness adjustment data of the white sub-pixel lights and a proportion of the light with one color in the white sub-pixel lights; and the brightness data of each one of the lights with other colors in the lights with various colors are greater than product of the brightness adjustment data of the white sub-pixel lights and the proportion of the one of the lights with other colors in the white sub-pixel lights.

The details of these steps in the above method according to the present disclosure will be explained further below with reference to embodiments.

Before the present image frame is displayed on a display, display data of the present image frame to be displayed are acquired from the signal source. The display data are typically RGB data including gray scale data for respective lights with various colors such RGB.

In the step 101, the gray scale data in the RGB data are converted into RGB brightness data. The conversion is typically achieved using a gamma curve.

The gamma curve is used to represent display brightness of the light with corresponding colors in various gray scales. At present, gamma curve 2.2 is usually used. It means that the display brightness value of the corresponding gray scale is $2.2^{th}$ power of the gray scales.

As an example, in the step 101 in an embodiment, the gamma curve for the respective lights with various colors used for gray scale conversion are obtained by adjusting standard gamma curve 2.2 in advance. Certainly, other gamma curves may also be used in the present disclosure, for example, gamma curve 1, gamma curve 2.5, which may be selected as required.

Optionally, the corresponding gamma curve may be obtained by testing and adjusting a test picture of a display before leaving the factory. The specific adjusting process is shown in FIG. 2.

Figure 2:
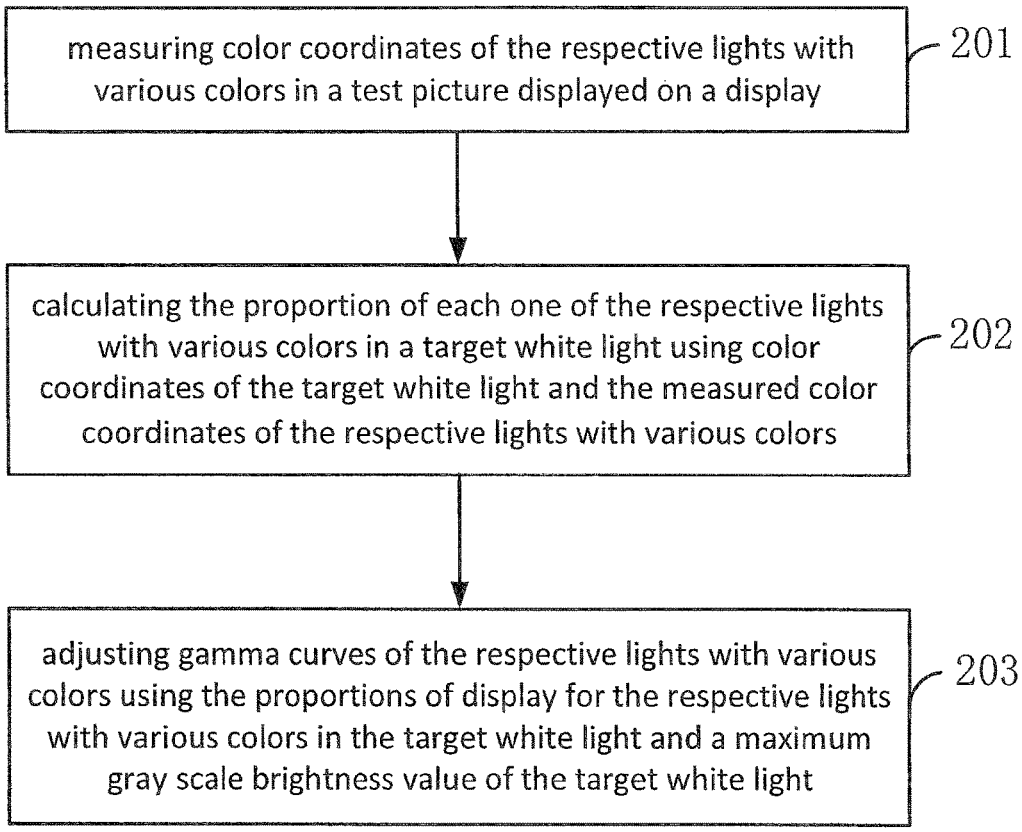
FIG. 2 is a flow chart of a method for adjusting gamma curves of the respective lights with various colors in the present disclosure.

As illustrated in FIG. 2, the specific process for adjusting the respective lights with various colors includes:

Step 201: measuring color coordinates of the respective lights with various colors in a test picture displayed on a display. The step may be performed by displaying a picture for each pure color (such as RGB) in a display and then measuring the color coordinates of the respective colors on light exit side of the display using a measuring device when the test picture is displayed.

Step 202: calculating the proportion of each one of the respective lights with various colors in a target white light using color coordinates of the target white light and the measured color coordinates of the respective lights with various colors. In the step, the target white light is a white light corresponding to a target color coordinate under preset white balance. Thus, the parameters, such as maximum gray scale brightness values, of the respective lights with various colors in ideal condition may be determined by calculating the proportions in display for the respective lights with various colors in the target white light.

Step 203: adjusting gamma curves of the respective lights with various colors using the proportions in display for the respective lights with various colors in the target white light and maximum gray scale brightness value of the target white light. In the step, on the basis of the proportions in display for the respective lights with various colors in the target white light under white balance, when the brightness values of the target white light is the maximum gray scale brightness value, the maximum gray scale brightness values of the lights with various colors may be calculated out and then the determined standard gamma curve is adjusted depending on the maximum gray scale brightness values of the respective lights with various colors. The standard gamma curve is a gamma curve which is determined in advance as required, such as gamma curve 2.2. The specific methods for adjusting the gamma curve belong to the common knowledge in the art and thus will be omitted herein.

Through the above steps, the adjusting of the gamma curves for the respective lights with various colors may be done by the target white light. During controlling the specific image display, when the gray scale data of the respective lights with various colors inputted by the signal source are received, the gray scale data may be converted into the brightness data on the basis of the adjusted gamma curves.

Since the present disclosure is directed to the WOLED display apparatus, a gamma curve for the white sub-pixel lights is also needed in display process. Therefore, while the gamma curves for the respective lights with various colors are adjusted, in the present disclosure, the gamma curve for the white sub-pixel lights also need to be adjusted. The specific adjusting process is shown in FIG. 3.

Figure 3:
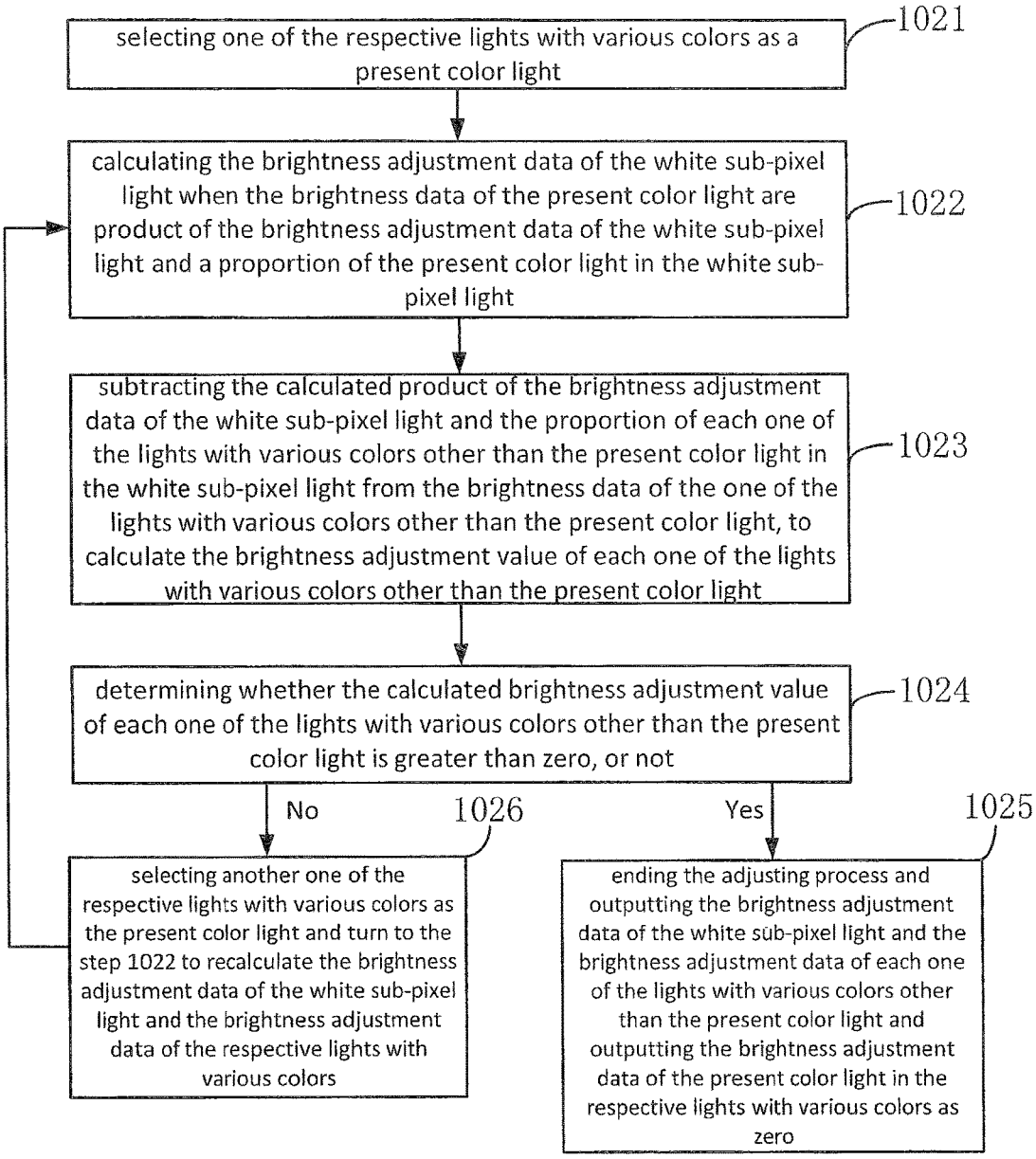
FIG. 3 is a flow chart of a method for adjusting gamma curves of the white sub-pixel lights in the present disclosure.

As shown in FIG. 3, the specific method for adjusting the gamma curve for the white sub-pixel lights includes:

Step 301: measuring color coordinates of the respective lights with various colors and color coordinates of the white sub-pixel lights in a test picture displayed on a display, and calculating the proportion of each one of the respective lights with various colors in the white sub-pixel lights using color coordinates of the respective lights with various colors and color coordinates of the white sub-pixel lights.

Like the above step 201, the step also uses the measuring device to perform the measurement on the light exit side of the display. The color coordinates of the light emitted from the white color sub-pixels may be measured by displaying a white picture separately, that is, the color coordinates of the white sub-pixel lights may be obtained. Correspondingly, the color coordinates of the lights emitted from the sub-pixels with other respective colors may also be tested by displaying a picture with other respective colors (such as color, green, blue) separately, that is, the color coordinates for the respective lights with various colors may be obtained. Then, the proportions of the respective lights with various colors in the light emitted from the white sub-pixels are obtained by using the color coordinates of the respective lights with various colors and color coordinates of the white sub-pixel lights. In an embodiment, the proportions of the respective lights with various colors in the white sub-pixel lights mean the proportions of the respective lights with various colors to the white sub-pixel lights in the lights emitted from the white sub-pixels. In principle of optical spectroscopy, the white light may typically be formed by mixing the respective lights with various colors such as red, green, blue at a proper proportion, for example, a certain grayscale white light may be composed of 0.33 red light, 0.33 green light and 0.34 blue light. In this way, the proportions of the respective lights with various colors (red, green, blue) in the white sub-pixels are 0.33, 0.33 and 0.34 respectively. Certainly, the step 301 and the step 201 may be carried out simultaneously. In a WOLED display apparatus, the respective lights with various colors are obtained by filtering the white light emitted by the white sub-pixels and the white sub-pixel lights are not filtered.

Step 302: determining the maximum gray scale brightness data of the white sub-pixel lights on the basis of the maximum gray scale brightness values of the respective lights with various colors and the proportion of each one of the respective lights with various colors in the white sub-pixel light.

As the gamma curves of the respective lights with various colors have been obtained by adjustment, the maximum gray scale brightness values of the respective lights with various colors may be obtained on the basis of the gamma curves. The maximum gray scale brightness data of the white sub-pixel lights to be determined meet the following two conditions:

the maximum gray scale brightness value of a light with one color in the lights with various colors are product of the maximum gray scale brightness value of the white sub-pixel lights and the proportion of the light with one color in the white sub-pixel lights; and the maximum gray scale brightness value of each one of the lights with other colors in the lights with various colors is greater than product of the maximum gray scale brightness value of the white sub-pixel lights and the proportion of the one of the lights with other colors in the white sub-pixel lights.

In the WOLED display apparatus, the respective lights with various colors are obtained by filtering the white light by corresponding filters, for example, the red light is obtained by filtering out the respective lights with colors other than red by a red filter. Further, the WOLED display apparatus further includes a white sub-pixel which outputs the white light directly without needing any filters to filter it. Thus, when a picture is displayed on the display finally, in order to ensure the brightness values of the respective lights with various colors to reach the required brightness values, in the present disclosure, the color cast problem can be solved by compensating for the lights emitted from the sub-pixels corresponding to the lights with other colors on the basis of the white light emitted from the white sub-pixels.

Thus, the maximum gray scale brightness value of the white sub-pixel lights is obtained by the above two conditions. In particular, it causes a light with one color in the respective lights with various colors to coincide with the brightness value for the proportion of the light with one color in the white sub-pixel lights. In this way, when a practical picture is displayed, the proportion of the light with one color in the white sub-pixel lights just coincides with the practical data to be displayed, thus, the sub-pixels corresponding to the light with such color does not need to emit lights, but the light with such color is obtained from the lights directly by the white sub-pixels. Meanwhile, besides the parts of the brightness values of the respective lights with other colors that are obtained from the white sub-pixel lights, the brightness values of the respective lights with other colors further needs the sub-pixels corresponding to the respective lights with other colors to emit lights so as to compensate for insufficient parts of colors, therefore, it needs the proportions of the respective lights with other colors in the white sub-pixel lights to be less than the color data to be displayed in practice.

As discussed above, taking the lights with three colors RGB as an example, the maximum gray scale brightness of the white sub-pixel lights may be derived by the following formula:

$$\begin{cases} R_{max} - R_s L_{smax} \\ G_{max} - G_s L_{smax} \\ B_{max} - B_s L_{smax} \end{cases} \quad (1)$$

where $R_{max}$ is maximum gray scale brightness value of red light, $G_{max}$ is maximum gray scale brightness value of green light, is maximum gray scale brightness value of blue light, $L_{smax}$ is maximum gray scale brightness value of blue light, $R_s$, $G_s$ and $B_s$ are proportions of the red light, the green light and the blue light in the white sub-pixel lights and may be calculated by the step 301.

In order to obtain the maximum gray scale brightness value $L_{smax}$ of the white sub-pixel lights, it is necessary to assume one formula of the above set of formula is equal to zero and other two formula are greater than zero. For example, at first, the value of $R_{max}-R_sL_{max}$ is assumed to be equal to zero to solve $L_{smax}$. The solved value of $L_{smax}$ ensures the value of $G_{max}-G_sL_{smax}$ and the value of $B_{max}-B_sL_{smax}$ are both greater than zero. Then, $L_{smax}$ may be determined as the maximum gray scale brightness value of the white sub-pixel lights.

Step 303: adjusting gamma curves of the white sub-pixel lights using the maximum gray scale brightness data of the white sub-pixel lights.

After the maximum gray scale brightness value of the white sub-pixel lights is obtained, the standard gamma curve to be determined in advance may be adjusted on the basis of the conventional adjusting mode of gamma curve.

In the step 101, the gray scale data of the respective lights with various colors to be displayed in practice are converted into brightness data. In the step 102, the brightness data of the respective lights with various colors to be displayed in practice are needed to adjust.

Thus, in the embodiment, the brightness values of the respective lights with various colors to be displayed may obtained by gamma conversion for the inputted gray scale data of the respective lights with various colors, then the brightness of the light to be emitted by the white sub-pixels is calculated using the proportions, calculated in advance, of the respective lights with various colors in the white sub-pixels and the brightness values of the respective sub-pixels with other colors to be compensated are calculated out while ensuring the sub-pixels with one of the various colors to not emit lights and finally, an inversion gamma conversion is performed to obtain the adjusted compensation data for other colors and the compensation data for white. In the above method, a light with one color in the lights emitted by the white sub-pixels has brightness just in coincidence with the practical requirements of the brightness value to be displayed, thus the sub-pixels corresponding to such color do not need to emit lights. Meanwhile, since the lights with other two colors in the lights emitted by the white sub-pixels have the brightness less than the brightness value to be displayed in practice, in the present disclosure, the insufficient part for the light with the two colors may be calculated to compensate for the insufficient part by the lights emitted by the sub-pixels corresponding to the lights with the other two colors.

In an example, the acquired brightness adjustment data of the white sub-pixel lights meet the following two conditions:

the brightness data of a light with one color in the lights with various colors are product of the brightness adjustment data of the white sub-pixel lights and a proportion of the light with one color in the white sub-pixel lights; and the brightness data of each one of the lights with other colors in the lights with various colors are greater than product of the brightness adjustment data of the white sub-pixel lights and the proportion of the one of the lights with other colors in the white sub-pixel lights.

The proportions of the respective lights with various colors in the white sub-pixel lights are obtained by practical measurements. That is, as discussed in the step 301, they are calculated out by the color coordinates of the respective lights with various colors and the white sub-pixel lights measured when a test picture is displayed in practice on the display device.

Figure 4:
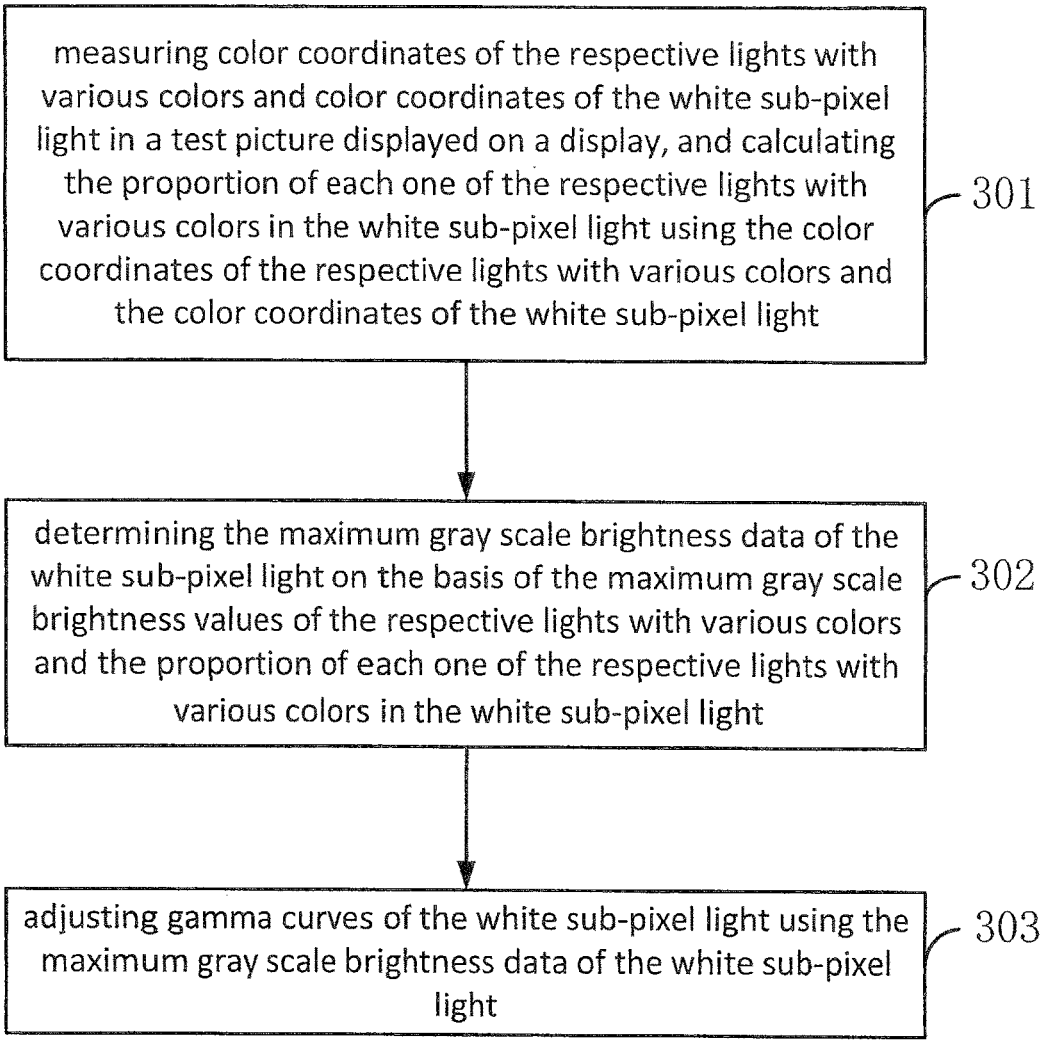
FIG. 4 is a flow chart of a method for adjusting the brightness adjustment data of the white sub-pixel lights and the brightness adjustment data of the respective lights with various colors in the present disclosure.

In an example, in the step 102, the brightness adjustment data of white sub-pixel lights and brightness adjustment data of the respective lights with various colors are acquired by the following means, as shown in FIG. 4, including:

Step 1021: selecting one of the respective lights with various colors as a present color light;

Step 1022: calculating the brightness adjustment data of the white sub-pixel light when the brightness data of the present color light are product of the brightness adjustment data of the white sub-pixel lights and the proportion of the present color light in the white sub-pixel lights;

Step 1023: subtracting the calculated product of the brightness adjustment data of the white sub-pixel lights and the proportion of each one of the lights with various colors other than the present color light in the white sub-pixel lights from the brightness data of the one of the lights with various colors other than the present color light, to calculate the brightness adjustment value of each one of the lights with various colors other than the present color light;

Step 1024: determining whether the calculated brightness adjustment value of each one of the lights with various colors other than the present color light is greater than zero; if yes, turn to the step 1025, otherwise, turn to the step 1026;

Step 1025: ending the adjusting process and outputting the brightness adjustment data of the white sub-pixel lights and the brightness adjustment data of each one of the lights with various colors other than the present color light and outputting the brightness adjustment data of the present color light in the respective lights with various colors as zero;

Step 1026: selecting another one of the respective lights with various colors as the present color light and turn to the step 1022 to recalculate the brightness adjustment data of the white sub-pixel light and the brightness adjustment data of the respective lights with various colors.

As discussed above, taking the lights with three colors RGB as an example, the brightness adjustment data of the white sub-pixel lights may be derived by the following formula:

$$\begin{cases} R_i - R_s L_s \\ G_i - G_s L_s \\ B_i - B_s L_s \end{cases} \quad (2)$$

where $R_i$ is an brightness value of red light, $G_i$ is an brightness value of green light, $B_i$ is an brightness value of blue light, these brightness values are obtained by the conversion based on the gray scale data to be displayed in practice; $L_s$ is brightness adjustment value of the white sub-pixel lights, i.e., the values that need to be solved by the above set of formula; $R_s$, $G_s$ and $B_s$ are proportions of the red light, the green light and the blue light in the white sub-pixel lights and may be measured in practice and calculated.

In order to obtain the brightness adjustment value $L_s$ of the white sub-pixel lights, it is necessary to assume one formula of the above set of formula (2) is equal to zero and other two formula are greater than zero. For example, at first, the red light is selected as the present color light and the value of $R_f-R_sL_s$ is assumed to be equal to zero to solve $L_s$. The solved value of $L_s$ ensures the value of $G_i-G_sL_s$ and the value of $B_i-B_sL_s$ are both greater than zero. Then, $L_s$ may be determined as the brightness adjustment value of the white sub-pixel lights. $G_i-G_sL_s$ and $B_i-B_sL_s$ are brightness adjustment values of the green light and the blue light, certainly the brightness adjustment value of the red light is zero. Otherwise, the green light and the blue light are selected as the present color light and the brightness adjustment value of the white sub-pixel lights are recalculated.

By the above means, the brightness adjustment values of the respective lights with various colors and the white sub-pixel lights may be obtained. In the example, the brightness adjustment value of the light with one color is zero and the brightness adjustment values of the lights with other two colors are differences between their corresponding brightness values and products of the brightness adjustment value of the white sub-pixel lights and the proportions of the respective lights with the corresponding colors in the white sub-pixel lights respectively. In practical display, the respective sub-pixels and the white sub-pixels are driven by the brightness adjustment values of the calculated respective lights with various colors and the white sub-pixel lights. Such adjustment may reduce power consumption to maximum extent as one of the sub-pixels does not emit light. Meanwhile, since the gamma curves used in conversion of the practical brightness values of the respective lights with various colors are obtained by measuring the proportions of the respective lights with various colors in the white sub-pixel lights and adjusting the gamma curve when the mixed lights of the respective lights with various colors and the white sub-pixel lights are in white balance, the light with one color is obtained directly by the light emitted from the white sub-pixels and only insufficient parts of the lights with the other two colors in the lights emitted from the white sub-pixels are emitted from other two sub-pixels. In this way, the color cast may be avoided.

In the step 103, the brightness adjustment data of white sub-pixel lights and brightness adjustment data of the respective lights with various colors are converted into gray scale data and the gray scale data are outputted and displayed.

After the above method in the present disclosure has been adjusted, for the WOLED display apparatus, the respective lights with various colors are obtained mainly from the white lights emitted by the white sub-pixels. In the sub-pixels corresponding to the respective lights with various colors, one sub-pixel is not needed to emit lights. The lights with the corresponding colors are obtained completely by the white light emitted by the white sub-pixel lights. The contents of the lights with other colors in the white light will not meet the practical requirements for display brightness, thus the lights emitted by the corresponding other sub-pixels may need to be compensated.

In the method for controlling image display proposed by the present disclosure, on the basis of the lights emitted by the white sub-pixels in practice, the sub-pixel corresponding to the light with one color does not emit light while the sub-pixels corresponding to other colors emit lights to calibrate the color coordinates. The above method proposed by the present disclosure may provide a simple calculation method which may be used to adjust the display data and may eliminate color cast.

Figure 5:
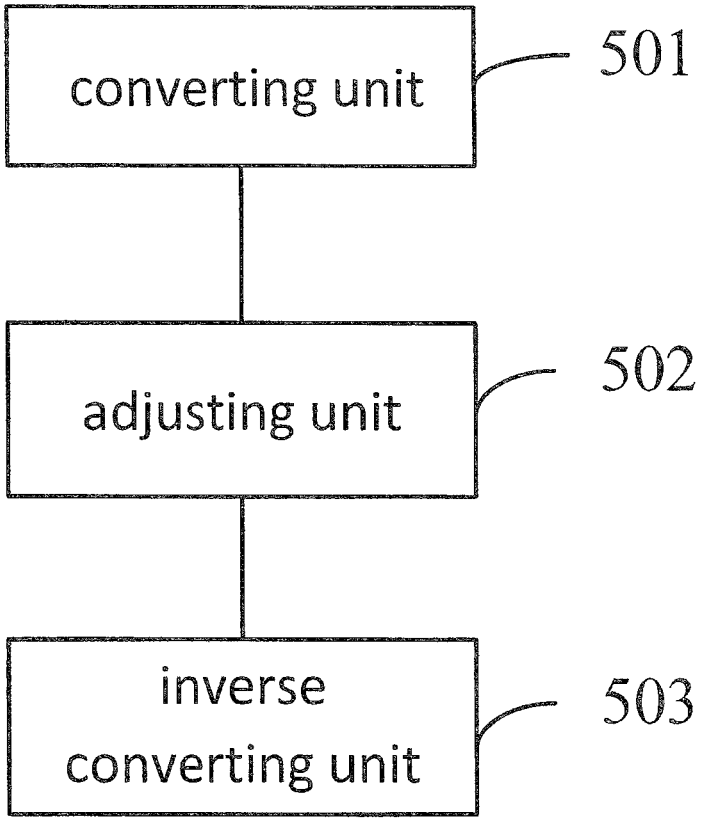
FIG. 5 is a block schematic view showing an apparatus for controlling image display of a WOLED display apparatus in the present disclosure.

FIG. 5 is a block schematic view showing an apparatus for controlling image display of a WOLED display apparatus in the present disclosure. As illustrated in FIG. 5, the apparatus includes:

a converting unit 501 configured to convert gray scale data of respective lights with various colors inputted by a signal source into brightness data of the respective lights with various colors;

an adjusting unit 502 configured to acquire brightness adjustment data of white sub-pixel lights and brightness adjustment data of the respective lights with various colors on the basis of the brightness data of the respective lights with various colors and proportions of the respective lights with various colors in the white sub-pixel lights;

an inverse converting unit 503 configured to convert the brightness adjustment data of white sub-pixel lights and brightness adjustment data of the respective lights with various colors into gray scale data and outputting and displaying the gray scale data;

wherein the brightness adjustment data of the white sub-pixel lights acquired by the adjusting unit meet the following two conditions:

the brightness data of a light with one color in the lights with various colors are product of the brightness adjustment data of the white sub-pixel lights and a proportion of the light with one color in the white sub-pixel lights; and the brightness data of each one of the lights with other colors in the lights with various colors are greater than product of the brightness adjustment data of the white sub-pixel lights and the proportion of the one of the lights with other colors in the white sub-pixel lights.

In order to acquire the brightness adjustment data of the white sub-pixel lights and the brightness adjustment data of the respective lights with various colors, as an example, the adjusting unit 502 may be configured to:

select one of the respective lights with various colors as a present color light and to calculate the brightness adjustment data of the white sub-pixel lights when the brightness data of the present color light are equal to product of the brightness adjustment data of the white sub-pixel lights and the proportion of the present color light in the white sub-pixel lights;

subtract the calculated product of the brightness adjustment data of the white sub-pixel lights and the proportion of each one of the lights with various colors other than the present color light in the white sub-pixel lights from the brightness data of the one of the lights with various colors other than the present color light, to calculate the brightness adjustment value of each one of the lights with various colors other than the present color light;

determine whether the calculated brightness adjustment value of each one of the lights with various colors other than the present color light is greater than zero;

output the brightness adjustment data of the white sub-pixel light and the brightness adjustment data of each one of the lights with various colors other than the present color light and output the brightness adjustment data of the present color light in the respective lights with various colors as zero if the calculated brightness adjustment value of each one of the lights with various colors other than the present color light is greater than zero, otherwise, select another one of the respective lights with various colors as the present color light and repeat the above steps to recalculate the brightness adjustment data of the white sub-pixel light and the brightness adjustment data of the respective lights with various colors.

The above apparatus for controlling image display in embodiments may be implemented by logic circuits, such as FPGA or other programmable circuits.

As an example, the apparatus for controlling image display further includes:

a gamma curve adjusting unit configured to adjust gamma curves of the respective lights with various colors and the white sub-pixel lights before controlling image display.

As an example, in order to adjust the gamma curves of the respective lights with various colors and the white sub-pixel lights, the gamma curve adjusting unit may be configured to:

measure color coordinates of the respective lights with various colors and color coordinates of the white sub-pixel lights in a test picture displayed on a display, and calculate the proportion of each one of the respective lights with various colors in the white sub-pixel lights using color coordinates of the respective lights with various colors and color coordinates of the white sub-pixel lights;

calculate the proportion of each one of the respective lights with various colors in a target white light using color coordinates of the target white light and the measured color coordinates of the respective lights with various colors;

determine the maximum gray scale brightness data of the respective lights with various colors using the maximum gray scale brightness data of the target white light and the proportions of the respective lights with various colors in the target white light;

adjust gamma curves of the respective lights with various colors respectively using the maximum gray scale brightness data of the respective lights with various colors;

determine the maximum gray scale brightness of the white sub-pixel lights on the basis of the maximum gray scale brightness values of the respective lights with various colors and the proportion of each one of the respective lights with various colors in the white sub-pixel lights; and adjust gamma curves of the white sub-pixel lights using the maximum gray scale brightness data of the white sub-pixel lights.

An embodiment in the present disclosure provides a WOLED display apparatus including the apparatus for controlling image display as described in any one of the above embodiments.

The above apparatus for controlling image display and WOLED display apparatus provided by the embodiment can make the brightness of the light with one color in the lights emitted from the white sub-pixels just coincide with the requirements for the brightness values of practical display. Thus, the sub-pixels corresponding to the color do not need to emit lights and may reduce power consumption to maximum extent. Meanwhile, as the brightness of the respective lights with various colors in the lights emitted by the white sub-pixels, the insufficient parts of the lights with other colors are calculated and compensated by the lights emitted by the sub-pixels corresponding to the other colors, so as to avoid the color cast.

Therefore, the above method and apparatus provided by embodiments in the present disclosure may provide a simple calculation method when adjusting the display data, reduce power consumption and eliminate color cast.

Although the above embodiments are given with reference to RUB three sub-pixels, the present disclosure is not limited to this. For example, the embodiments in the present disclosure may also be used in the display apparatus with the sub-pixels for other colors such as red, green, blue or yellow.

The specific functions of the respective units in the apparatus for controlling image display in the present disclosure substantially coincide with those described in the above method for controlling image display. Thus, the details may be found in the description for the method and will be omitted below.

The present disclosure provides a display apparatus including an apparatus for controlling image display of a WOLED display apparatus.

The above embodiments are only intended to further explain the object, solution and advantages in the present disclosure by way of examples, instead of limiting the present invention. It would be appreciated by those skilled in the art that various changes, modifications or equivalents will also fall within the scope of the present invention, without departing from the principles and spirit of the disclosure.

What is claimed is:

1. A method for controlling image display of a WOLED display apparatus, comprising:

converting gray scale data of respective lights with various colors inputted from a signal source into brightness data of the respective lights with various colors;

acquiring brightness adjustment data of a white sub-pixel light and brightness adjustment data of the respective lights with various colors on the basis of the brightness data of the respective lights with various colors and proportions of the respective lights with various colors in the white sub-pixel light;

converting the brightness adjustment data of white sub-pixel light and brightness adjustment data of the respective lights with various colors into gray scale data and outputting and displaying the gray scale data;

wherein the brightness adjustment data of the white sub-pixel light acquired meet the following two conditions:

the brightness data of a light with one color in the lights with various colors is a product of the brightness adjustment data of the white sub-pixel light and a proportion of the light with the one color in the white sub-pixel light; and the brightness data of each one of the lights with other colors in the lights with various colors is greater than a product of the brightness adjustment data of the white sub-pixel light and a proportion of the one of the lights with other colors in the white sub-pixel light, and wherein acquiring brightness adjustment data of a white sub-pixel light and brightness adjustment data of the respective lights with various colors on the basis of the brightness data of the respective lights with various colors and proportions of the respective lights with various colors in the white sub-pixel light comprises:

selecting one of the respective lights with various colors as a present color light and calculating the brightness adjustment data of the white sub-pixel light when the brightness data of the present color light is a product of the brightness adjustment data of the white sub-pixel light and a proportion of the present color light in the white sub-pixel light;

subtracting the product of the brightness adjustment data of the white sub-pixel light and the proportion of each one of the lights with various colors other than the present color light in the white sub-pixel light from the brightness data of the one of the lights with various colors other than the present color light, so as to obtain the brightness adjustment value of each one of the lights with various colors other than the present color light;

determining whether or not the obtained brightness adjustment value of each one of the lights with various colors other than the present color light is greater than zero;

outputting the brightness adjustment data of the white sub-pixel light and the brightness adjustment data of each one of the lights with various colors other than the present color light and outputting zero as the brightness adjustment data of the present color light in the respective lights with various colors if the brightness adjustment value of each one of the lights with various colors other than the present color light is greater than zero; otherwise, selecting another one of the respective lights with various colors as the present color light and repeating the above steps to recalculate the brightness adjustment data of the white sub-pixel light and the brightness adjustment data of the respective lights with various colors.

2. The method according to claim 1, wherein the brightness adjustment data of the light with the one color are zero and the brightness adjustment data of each one of the lights with other colors are obtained by subtracting the product of the brightness adjustment data of the white sub-pixel light and the proportion of the one of the lights with other colors in the white sub-pixel light from the brightness data of the one of the lights with other colors.

3. The method according to claim 1, wherein the proportions of the respective lights with various colors in the white sub-pixel light are obtained by measuring color coordinates of light emitted by a white sub-pixel and color coordinates of light emitted by respective sub-pixels of various colors.

4. The method according to claim 1, wherein converting gray scale data of respective lights with various colors inputted from a signal source into brightness data of the respective lights with various colors and converting the brightness adjustment data of the white sub-pixel light and brightness adjustment data of the respective lights with various colors into gray scale data are achieved by conversions based on gamma curves of the respective lights with various colors and the white sub-pixel light.

5. The method according to claim 4, further comprising: adjusting the gamma curves of the respective lights with various colors and the white sub-pixel light in advance before the conversions based on the gamma curves of the respective lights with various colors and the white sub-pixel light are performed.

6. The method according to claim 5, wherein adjusting the gamma curves of the respective lights with various colors in advance comprises:

measuring color coordinates of the respective lights with various colors in a test picture displayed on a display;

calculating the proportion of each one of the respective lights with various colors in a target white light by using color coordinates of the target white light and measured color coordinates of the respective lights with various colors;

determining the maximum gray scale brightness data of the respective lights with various colors by using the maximum gray scale brightness data of the target white light and the proportions of the respective lights with various colors in the target white light; and adjusting the gamma curves of the respective lights with various colors respectively by using the maximum gray scale brightness data of the respective lights with various colors.

7. The method according to claim 5, wherein adjusting the gamma curve of the white sub-pixel light in advance comprises:

measuring color coordinates of the respective lights with various colors and color coordinates of the white sub-pixel light in a test picture displayed on a display, and calculating the proportion of each one of the respective lights with various colors in the white sub-pixel light by using the color coordinates of the respective lights with various colors and the color coordinates of the white sub-pixel light;

determining the maximum gray scale brightness data of the white sub-pixel light on the basis of the maximum gray scale brightness values of the respective lights with various colors and the proportion of each one of the respective lights with various colors in the white sub-pixel light; and adjusting the gamma curve of the white sub-pixel light by using the maximum gray scale brightness data of the white sub-pixel light.

8. The method according to claim 7, wherein the maximum gray scale brightness data of the white sub-pixel light meets the following two conditions:

the maximum gray scale brightness value of a light with one color in the lights with various colors is a product of the maximum gray scale brightness value of the white sub-pixel light and the proportion of the light with the one color in the white sub-pixel light; and the maximum gray scale brightness value of each one of the lights with other colors in the lights with various colors is greater than a product of the maximum gray scale brightness value of the white sub-pixel light and the proportion of the one of the lights with other colors in the white sub-pixel light.

9. The method according to claim 8, wherein the maximum gray scale values of the respective lights with various colors are obtained from the adjusted gamma curves of the respective lights with various colors.

10. The method according to claim 1, wherein the various colors comprise three colors of red, green and blue.

11. An apparatus for controlling image display of a WOLED display apparatus, comprising:

memory;

one or more processors; and one or more modules stored in the memory and configured for execution by the one or more processors, the one or more modules comprising instructions:

to convert gray scale data of respective lights with various colors inputted from a signal source into brightness data of the respective lights with various colors;

to acquire brightness adjustment data of a white sub-pixel light and brightness adjustment data of the respective lights with various colors on the basis of the brightness data of the respective lights with various colors and proportions of the respective lights with various colors in the white sub-pixel light; and to convert the brightness adjustment data of the white sub-pixel light and the brightness adjustment data of the respective lights with various colors into gray scale data and outputting and displaying the gray scale data;

wherein the brightness adjustment data of the white sub-pixel lights meet the following two conditions:

the brightness data of a light with one color in the lights with various colors are product of the brightness adjustment data of the white sub-pixel light and a proportion of the light with the one color in the white sub-pixel light; and the brightness data of each one of the lights with other colors in the lights with various colors are greater than product of the brightness adjustment data of the white sub-pixel light and a proportion of the one of the lights with other colors in the white sub-pixel light, and wherein the instruction to acquire brightness adjustment data of a white sub-pixel light and brightness adjustment data of the respective lights with various colors on the basis of the brightness data of the respective lights with various colors and proportions of the respective lights with various colors in the white sub-pixel light comprises instructions:

to select one of the respective lights with various colors as a present color light and to calculate the brightness adjustment data of the white sub-pixel light when the brightness data of the present color light are equal to product of the brightness adjustment data of the white sub-pixel light and the proportion of the present color light in the white sub-pixel light;

to subtract the product of the brightness adjustment data of the white sub-pixel light and the proportion of each one of the lights with various colors other than the present color light in the white sub-pixel light from the brightness data of the one of the lights with various colors other than the present color light, so as to obtain the brightness adjustment value of each one of the lights with various colors other than the present color light;

to determine whether or not the obtained brightness adjustment value of each one of the lights with various colors other than the present color light is greater than zero; and to output the brightness adjustment data of the white sub-pixel light and the brightness adjustment data of each one of the lights with various colors other than the present color light and output zero as the brightness adjustment data of the present color light in the respective lights with various colors if the brightness adjustment value of each one of the lights with various colors other than the present color light is greater than zero, otherwise, to select another one of the respective lights with various colors as the present color light and repeat the above steps to recalculate the brightness adjustment data of the white sub-pixel light and the brightness adjustment data of the respective lights with various colors.

12. The apparatus according to claim 11, wherein the one or more modules further comprise an instruction:

to adjust gamma curves of the respective lights with various colors and the white sub-pixel light before controlling image display.

13. The apparatus according to claim 12, wherein the instruction to adjust gamma curves of the respective lights with various colors and the white sub-pixel light before controlling image display comprises instructions:

to measure color coordinates of the respective lights with various colors and color coordinates of the white sub-pixel light in a test picture displayed on a display, and to calculate the proportion of each one of the respective lights with various colors in the white sub-pixel light by using the color coordinates of the respective lights with various colors and the color coordinates of the white sub-pixel light;

to calculate a proportion of each one of the respective lights with various colors in a target white light by using color coordinates of the target white light and measured color coordinates of the respective lights with various colors;

to determine the maximum gray scale brightness data of the respective lights with various colors by using the maximum gray scale brightness data of the target white light and the proportions of the respective lights with various colors in the target white light;

to adjust gamma curves of the respective lights with various colors respectively by using the maximum gray scale brightness data of the respective lights with various colors;

to determine the maximum gray scale brightness data of the white sub-pixel light on the basis of the maximum gray scale brightness values of the respective lights with various colors and the proportion of each one of the respective lights with various colors in the white sub-pixel light; and to adjust the gamma curve of the white sub-pixel light by using the maximum gray scale brightness data of the white sub-pixel light.

14. A WOLED display apparatus comprising the apparatus according to claim 11.

15. The display apparatus according to claim 14, wherein the one or more modules further comprises an instruction to adjust gamma curves of the respective lights with various colors and the white sub-pixel light before controlling image display.

16. The display apparatus according to claim 15, wherein the instruction to adjust gamma curves of the respective lights with various colors and the white sub-pixel light before controlling image display comprises instructions:

to measure color coordinates of the respective lights with various colors and color coordinates of the white sub-pixel light in a test picture displayed on a display, and to calculate the proportion of each one of the respective lights with various colors in the white sub-pixel light by using the color coordinates of the respective lights with various colors and the color coordinates of the white sub-pixel light;

to calculate a proportion of each one of the respective lights with various colors in a target white light by using color coordinates of the target white light and measured color coordinates of the respective lights with various colors;

to determine the maximum gray scale brightness data of the respective lights with various colors by using the maximum gray scale brightness data of the target white light and the proportions of the respective lights with various colors in the target white light;

to adjust gamma curves of the respective lights with various colors respectively by using the maximum gray scale brightness data of the respective lights with various colors;

to determine the maximum gray scale brightness data of the white sub-pixel light on the basis of the maximum gray scale brightness values of the respective lights with various colors and the proportion of each one of the respective lights with various colors in the white sub-pixel light; and to adjust the gamma curve of the white sub-pixel light by using the maximum gray scale brightness data of the white sub-pixel light.

17. The method according to claim 2, wherein the proportions of the respective lights with various colors in the white sub-pixel light are obtained by measuring color coordinates of light emitted by a white sub-pixel and color coordinates of light emitted by respective sub-pixels of various colors.

* * * * *